US012251004B2

(12) United States Patent
Hamaty

(10) Patent No.: US 12,251,004 B2
(45) Date of Patent: Mar. 18, 2025

(54) LUGGAGE ACCESSORY, LUGGAGE ASSEMBLY, AND METHOD OF FORMING LUGGAGE ASSEMBLY

(71) Applicant: RSH Holdings Limited, Grand Cayman (KY)

(72) Inventor: Robert Michael Hamaty, Grand Cayman (KY)

(73) Assignee: RSH HOLDINGS LIMITED, Grand Cayman (KY)

( * ) Notice: Subject to any disclaimer, the term of this patent is extended or adjusted under 35 U.S.C. 154(b) by 0 days.

(21) Appl. No.: 16/871,870

(22) Filed: May 11, 2020

(65) Prior Publication Data

US 2021/0345746 A1 Nov. 11, 2021

(51) Int. Cl.

| | |
|---|---|
| ***A45C 13/30*** | (2006.01) |
| ***A45C 5/03*** | (2006.01) |
| ***A45C 5/14*** | (2006.01) |
| ***A45C 13/00*** | (2006.01) |
| ***A45C 13/26*** | (2006.01) |

(52) U.S. Cl.

CPC ..... *A45C 13/30* (2013.01); *A45C 5/03* (2013.01); *A45C 5/14* (2013.01); *A45C 13/001* (2013.01); *A45C 13/262* (2013.01); *A45C 2013/267* (2013.01); *A45C 2013/306* (2013.01)

(58) Field of Classification Search

CPC .. A45C 5/03; A45C 5/02; A45C 13/36; A45C 5/14; A45C 2005/037; A45C 13/30; A45C 13/001; A45C 13/262; A45C 2013/267

USPC ..... 190/18 A

See application file for complete search history.

(56) References Cited

U.S. PATENT DOCUMENTS

| | | | | |
|---|---|---|---|---|
| 4,759,431 A * | 7/1988 | King | ..... | A45C 13/262 190/18 A |
| 4,995,487 A | 2/1991 | Plath | | |
| D438,374 S | 3/2001 | Hayman | | |
| D459,875 S | 7/2002 | Mack | | |
| D507,103 S | 7/2005 | Charles, Jr. | | |
| 7,909,149 B2 * | 3/2011 | Marji | ..... | A45C 7/0045 190/18 R |
| D655,496 S | 3/2012 | Lamey | | |
| D670,497 S | 11/2012 | Phillips | | |
| D713,137 S | 9/2014 | Wahib | | |

(Continued)

FOREIGN PATENT DOCUMENTS

| | | | |
|---|---|---|---|
| CN | 112515309 A * | 3/2021 | |
| WO | WO-9633634 A1 * | 10/1996 | ..... A45C 5/14 |

OTHER PUBLICATIONS

Frienda Add a Bag Luggage Strap—available for sale on Amazon.com on Jan. 15, 2018, product information retrieved from URL URL [See Below] on Jan. 25, 2022 (Year: 2018).*

(Continued)

*Primary Examiner* — Nathan J Jenness
*Assistant Examiner* — Jessica Kavini Tamil
(74) *Attorney, Agent, or Firm* — FITCH, EVEN, TABIN & FLANNERY, LLP

(57) ABSTRACT

A luggage accessory includes a sleeve including at least two openings. A luggage assembly includes at a handle of at least one piece of rollable luggage disposed through two openings of a sleeve. A method of forming a luggage assembly comprises disposing at least one handle of a piece of rollable luggage through a sleeve.

9 Claims, 7 Drawing Sheets

(56) References Cited

U.S. PATENT DOCUMENTS

| | | | | |
|---|---|---|---|---|
| 9,033,125 | B2 | 5/2015 | Herold | |
| 9,332,817 | B2 | 5/2016 | Salek | |
| 10,076,166 | B2 | 9/2018 | Kim | |
| D832,575 | S | 11/2018 | Carner | |
| D835,408 | S | 12/2018 | Justiss | |
| 11,304,486 | B2 * | 4/2022 | Ayhan | A45C 13/262 |
| 2008/0308369 | A1 | 12/2008 | Louis | |
| 2009/0139813 | A1 * | 6/2009 | Francis | A45C 13/00 190/117 |
| 2009/0159386 | A1 | 6/2009 | Kuhn | |
| 2013/0175129 | A1 | 7/2013 | Rankin et al. | |
| 2013/0333996 | A1 | 12/2013 | Selvi | |
| 2015/0014949 | A1 | 1/2015 | Dittman | |
| 2017/0042302 | A1 * | 2/2017 | Farrelly | A45C 7/0045 |
| 2017/0181514 | A1 | 6/2017 | Castillo | |
| 2018/0271310 | A1 | 9/2018 | Klugh et al. | |
| 2019/0216197 | A1 * | 7/2019 | Katz | A45C 13/28 |

OTHER PUBLICATIONS

URL for NPL above is https://www.amazon.com/Frienda-Luggage-Adjustable-Suitcase-Accessories/dp/B0791D9NVR/ref=sr_1_27?crid= 1OF3WU27417VX&keywords=travel+straps+for+luggage&qid=16431491 (Year: 2018).*

"Super Size Rubber Bands" by Amazon.com, retrieved from URL listed below, on Aug. 5, 2022 (Year: 2018).*

URL for NPL above (entry U) https://www.amazon.com/ANPHSIN-Pieces-Rubber-Bands-Garbage/dp/B07GJ25LMK/ref=sr_1_6?crid=3QUTLABOGJ7WO&keywords=long%2Brubber%2Bband&qid=1659730857&rnid=1248943011&s=office-products&sprefix=long%2Brubber%2Bband%2Caps%2C109&sr=1-6&th=1 (Year: 2018).*

Frienda,https://www.amazon.com/Frienda-Luggage-Adjustable-Suitcase-Accessories/dp/B0791D9NVR/ref=sr_1_27?crid=1OF3WU27417VX&keywords=travel+straps+for+luggage&qid=1643149161&sprefix=travel+strap%2Caps%2C106&sr=8-27 (Year: 2018).*

Luggaroo Kup Kaddy, reviewed Nov. 24, 2019 [online], [site visited May 24, 2022]. Available from internet, URL: <https:// www.amazon.com/Luggaroo-Kup-Kaddy-Handsfree-Telescoping/product-reviews/B081J7XH7P/> (Year: 2019); 2 Pages.

Riemot Luggage Travel Cup Holder, announced Sep. 19, 2019 [online], [site visited May 25, 2022]. Available from internet, URL: <https://www.amazon.com/dp/B07TXCCQGP/> (Year: 2019); 1 Page.

Office Action dated Jun. 1, 2022, in U.S. Appl. No. 29/735,441, 11 pages.

* cited by examiner

LUGGAGE ACCESSORY, LUGGAGE ASSEMBLY, AND METHOD OF FORMING LUGGAGE ASSEMBLY

FIELD

The present disclosure relates to rollable luggage and accessories suitable for use with rollable luggage.

BACKGROUND

Rollable luggage, e.g., wheeled suitcases, bags, etc., are typically used for transporting personal belongings during travel. Rollable luggage can be used during many modes of transportation such as travel by any one or more of plane, car, train, bus, boat, etc. Rollable luggage can be constructed of any one or more useful materials such as fabrics, metals, polymeric materials, rubber, etc. Rollable luggage is made in a variety of shapes and sizes suitable for carrying different volumes and types of items.

Different types of rollable luggage exist. For example, some rollable luggage includes an extendable handle and two wheels disposed on the bottom of the piece of luggage. The handle can be used for tilting the luggage and pulling or pushing the luggage.

Another type of rollable luggage includes an extendable handle and more than two wheels, e.g., four caster wheels. This type of rollable luggage can generally be rolled in an upright position without tilting. The luggage can also generally be rolled and spun in any direction without tilting the luggage. A walking user can generally grasp the handle and guide this type of luggage at their side while walking.

However, even with the foregoing rollable luggage, a user may still have to exert additional effort when moving multiple pieces of luggage, bags, and variety of other items typically carried in transit.

SUMMARY

It has surprisingly been discovered that a luggage accessory can join pieces upright rollable luggage into a luggage assembly and permit movement of the luggage as a unit. It has also been found that a luggage accessory can be fitted to rollable luggage and assist with carrying additional items.

A luggage accessory can generally comprise a sleeve including open opposite ends. The sleeve can generally receive through the open opposite ends at least one extended luggage handle attached to a piece of rollable luggage. In some aspects, the sleeve can receive through the open opposite ends two extended luggage handles attached to separate pieces of upright rollable luggage.

The sleeve can conform to surfaces of one or more extended luggage handles received by sleeve. The luggage accessory can retain together handles attached to separate pieces of upright rollable luggage, when the sleeve receives and conforms to surfaces of the handles. A luggage accessory can provide for single-handed movement of two luggage pieces when handles of the luggage pieces are retained by the sleeve.

A luggage accessory can generally include one or more pockets disposed on a sleeve. Such a pocket can carry any number of items when the luggage accessory is attached to one or more handles of rollable luggage.

A luggage assembly can generally comprise first and second pieces of upright rollable luggage with extendable handles of the first and second pieces of upright rollable luggage aligned and disposed together though two openings of a sleeve. The sleeve can conform to and retain together the first and second pieces of upright rollable luggage.

A method of forming a luggage assembly can generally comprise positioning an extended handle of a first piece of upright rollable luggage adjacent to and in alignment with an extended handle of a second piece of upright rollable luggage; and inserting the handles of the upright rollable luggage through a sleeve including two openings. The sleeve can simultaneously conform to and retain together the extended handles of the first and second pieces of upright rollable luggage.

DETAILED DESCRIPTION

Figure 1:
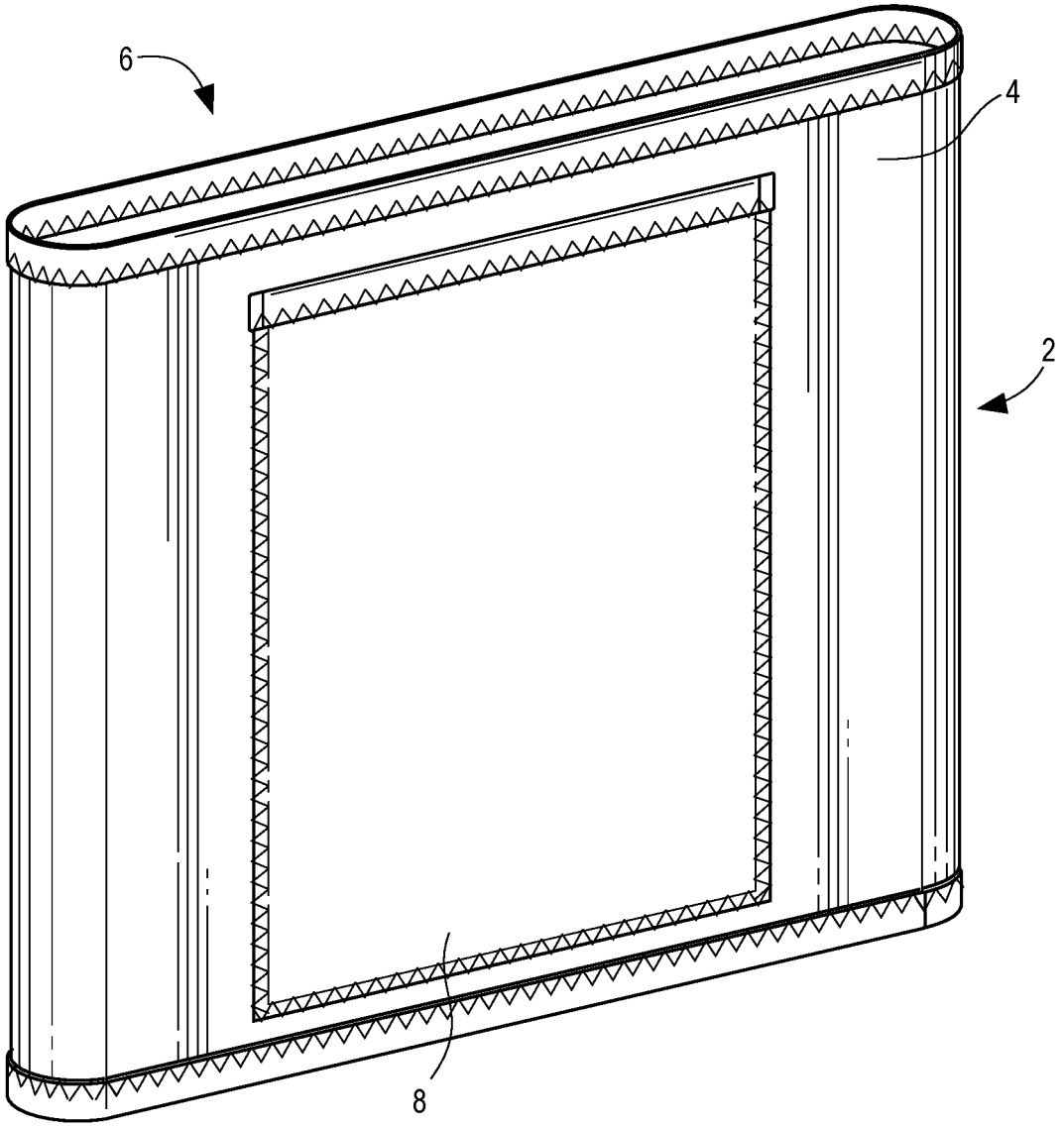
FIG. 1 illustrates a perspective view of an embodiment of a luggage accessory.

A piece of rollable luggage can generally include a luggage handle that is attached to the piece of luggage. A luggage handle can be extendable to an extended position and collapsible to a collapsed position. A luggage handle can generally be converted from a collapsed position to an extended position using any construction or structure. In some aspects, a luggage handle can be converted from a collapsed position to an extended position by telescoping mechanism included in the luggage handle or the luggage. In some aspects, a luggage handle includes spaced apart stanchions attached to a piece of rollable luggage. Spaced apart stanchions can be comprised in a mechanism permitting reversible collapse and extension of a luggage handle.

Rollable luggage generally includes wheels that permit rolling of the luggage across a surface. Upright rollable luggage can be easily rolled in an upright orientation without tilting the piece of luggage. Generally, upright rollable luggage includes more than two wheels that permit rolling of the piece of luggage in a upright orientation without tilting the luggage. In some embodiments, a piece of upright rollable luggage includes four caster wheels disposed on a bottom of the luggage. These wheels permit the piece of luggage to be spun or rolled in a number of different directions in an upright orientation without tilting the piece of luggage. Tilt rollable luggage can generally include an extendable handle and any number of wheels. The handle of a piece of tilt rollable luggage can be grasped to tilt the luggage on the wheels and pull or push the luggage on the wheels.

A user can attempt to move multiple pieces of rollable luggage at one time. For example, a user can attempt to move two pieces of upright rollable luggage by grasping handles of both pieces of luggage with one hand. Such a procedure can require additional effort to grasp and retain together both handles using one hand. The procedure can require even more effort if the luggage is heavily loaded, if the luggage is to be moved up or down an incline, if the user has small hands, weak grip strength, arthritis, etc. For similar reasons, additional effort may be required when moving four separate pieces of upright rollable luggage at the same time using two hands. For example, a user may need to exert additional effort to grasp and retain together two handles of separate pieces of upright rollable luggage in each hand. In addition, when a user rolls a single piece of rollable luggage with one hand, the user's other hand may be grasping a handbag or other item and may not be free to carry additional items.

It has surprisingly been discovered that a luggage accessory can join separate pieces upright rollable luggage into a luggage assembly and permit movement of the luggage as a unit. Such movement can also be achieved with one hand. It has also been found that a luggage accessory can be fitted to rollable luggage and assist with carrying additional items.

A luggage accessory can generally comprise a sleeve including two or more openings disposed on opposite ends of the sleeve. In some aspects, a sleeve comprise a tube-shaped member. In some embodiments, a sleeve can generally be formed, or flexible so as to provide, an oblong or elliptical cross-section when viewed at a direction through two or more openings at opposite ends of the sleeve.

In some aspects, a sleeve can be configured to receive through two openings at least one extended luggage handle of a piece of rollable luggage. In some aspects, a sleeve can be configured to simultaneously receive through two openings a first extended luggage handle attached to a first piece of upright rollable luggage and a second extended luggage handle attached to a second piece of upright rollable luggage.

A sleeve can generally be configured conform to surfaces of at least one extended luggage handle received through two openings of the sleeve. In some aspects, a sleeve can be configured to conform to surfaces of spaced apart stanchions of an extended luggage handle received through two openings of the sleeve. In some embodiments, a sleeve can be configured to simultaneously conform to and retain together a first extended luggage handle and a second extended luggage handle of first and second pieces of rollable luggage. In some embodiments, a sleeve is configured to simultaneously retain together and conform to spaced apart stanchions of both a first extended luggage handle and a second extended luggage handle.

Generally, a sleeve can accommodate, conform to, and retain together one or more extended luggage handles, and optionally spaced apart stanchions of one more extended luggage handles, by expansion and contraction of the sleeve. A sleeve can generally comprise any one or more useful materials of construction and structures that permit expansion and contraction. Examples of useful materials include any one or more of fabric, natural rubber, synthetic rubber, polymeric material, natural fiber, synthetic fiber, metal, etc. In some embodiments, a sleeve comprises neoprene rubber. In some aspects, a sleeve can generally can comprise an elastic tube-shaped member that is sewn, extruded, molded, etc. into a tube shape. In some embodiments, a sleeve can also be formed as a wrap configured to be opened from and closed back to a tube shape using a fastening mechanism, e.g., Velcro, snaps, laces, cam buckle, hooks, etc. Such a wrap can include adequate adjustment capability to accommodate a wide variety of extendable luggage handles.

A grasping area of a sleeve can generally be characterized as an area of a circle, ellipse, or any other regular or irregular shape viewed through a passage between two or more openings of the sleeve. In some aspects, a sleeve can comprise elastic material to permit expansion and contraction of a grasping area of the sleeve. A sleeve comprising elastic material can have sufficient strength and resilience to permit expansion of a grasping area of the sleeve when two extended luggage handles are inserted through two openings of the sleeve and then constrict the grasping area of the sleeve to conform to surfaces of both handles and retain together the handles. A sleeve comprising elastic material can also have sufficient strength and resilience to retain together handles of separate pieces of upright rollable luggage when rolling the joined pieces of luggage across a surface. Generally, a sleeve comprising elastic material can also constrict and conform to spaced apart stanchions of each of two extendable luggage handles of separate pieces of upright rollable luggage. In addition, a sleeve comprising elastic material can constrict to conform to spaced apart stanchions of a single luggage handle attached to a piece of rollable luggage.

In some aspects, a sleeve can comprise one or more adjustable structures, such as straps, bands, wires, etc., that can be used to adjust a grasping area of the sleeve. For example, such adjustable structures may be loosened to expand a grasping area of the sleeve to accommodate two extended luggage handles inserted through two openings of the sleeve and tightened to constrict the grasping area of the sleeve to conform to the two handles. Similarly, such adjustable structures may be loosened to expand a grasping area of the sleeve to accommodate a luggage handles inserted through two openings of the sleeve and tightened to constrict the grasping area of the sleeve to conform to the handle. Generally, a sleeve comprising one or more adjustable structures can constrict to conform to spaced apart stanchions of extendable luggage handles attached to separate pieces of upright rollable luggage. Generally, a sleeve comprising one or more adjustable structures can also constrict to conform to spaced apart stanchions attached of a single extendable luggage handle attached to a piece of rollable luggage.

A luggage accessory can also comprise one or more pockets disposed on an outside of a sleeve. Such pockets can be used to hold items such as mobile electronic devices (e.g., cell phones, music players, etc.), beverages, a container of hand sanitizer, snacks, tickets, change, money, etc. In some aspects, one or more pockets can be used when a luggage accessory is attached to one or more extended handles of one or more pieces of rollable luggage. A pocket can comprise elastic material configured to expand to receive an item yet retain the item in place. A pocket can optionally include a closure to secure an item in the pocket.

A luggage assembly can generally comprise any number of pieces of luggage, such as one or two pieces of luggage. In an aspect, a luggage assembly can include a luggage accessory including a sleeve coupled to first and second pieces of upright rollable luggage, each including wheels. Handles of first and second pieces of upright rollable luggage can be extended upward from the pieces of luggage, upward being a direction away from a surface on which wheels of the first and second pieces of luggage rest. The extended handle of the first piece of upright rollable luggage can be aligned with and positioned adjacent to the extended handle of the second piece of upright rollable luggage. The handles of the first and second pieces of upright rollable luggage can be disposed through two openings of a sleeve of the luggage accessory. The sleeve can conform to and retain together the handles of the first and second pieces of luggage.

Generally, a luggage assembly including a sleeve receiving, conforming to, and retaining together two extended handles of separate pieces of upright rollable luggage permits single-handed joined movement of the luggage assembly. In addition, in the case of two such luggage assemblies, a user can move four pieces of upright rollable luggage with a first luggage assembly including two pieces of upright rollable luggage and a second luggage assembly including another two pieces of upright rollable luggage. A user can move the first luggage assembly with a first hand and the second luggage assembly with a second hand.

Handles of one or both pieces of luggage included in a luggage assembly can optionally include spaced apart stanchions extending from a piece of luggage. In some embodiments, a sleeve of a luggage assembly simultaneously retains together and conforms to the spaced apart stanchions of two handles of attached to separate pieces of upright rollable luggage.

In some aspects, a luggage assembly can comprise a piece of rollable luggage (e.g., of tilt rollable, upright rollable luggage, etc.) including wheels and an extended handle. The luggage assembly can further comprise a luggage accessory including a sleeve including two openings through which the handle is disposed. The sleeve can conform to and grip the handle and include one or more pockets. As noted above, such pockets can hold items such as mobile electronic devices, beverages, snacks, etc.

A luggage assembly can generally be formed using any method. In some aspects, a method can comprise positioning an extended handle of one piece of upright rollable luggage adjacent to and in alignment with an extended handle of another piece upright rollable luggage. The method can further comprise inserting extended handles of the first and second pieces of luggage through a sleeve including two openings such that sleeve simultaneously conforms to and retains together the extended handles of the first and second pieces of luggage. Extended handles of luggage pieces can be inserted through a sleeve at the same time or separately.

In some aspects, a method of forming a luggage assembly can further comprise disposing on a surface a first piece of upright rollable luggage including wheels and an extendable handle, with the wheels contacting the surface, and disposing on the surface a second piece of upright rollable luggage including wheels and an extendable handle, with the wheels contacting the surface. In some embodiments, a method of forming a luggage assembly can further comprise extending extendable handles of first and second pieces of upright rollable luggage.

FIG. 1 illustrates a perspective view of an embodiment of a luggage accessory 2 comprising sleeve 4 including two openings 6 on opposite ends of the sleeve (only one opening shown in FIG. 1). FIG. 1 further shows a pocket 8 disposed on a side of the sleeve. The luggage accessory illustrated in FIG. 1 comprises a rectangular piece of fabric covered neoprene rubber sewn into a tube shape. Additional rectangular pieces of material are sewn onto opposite sides of the sleeve to form pockets 8.

Figure 2:
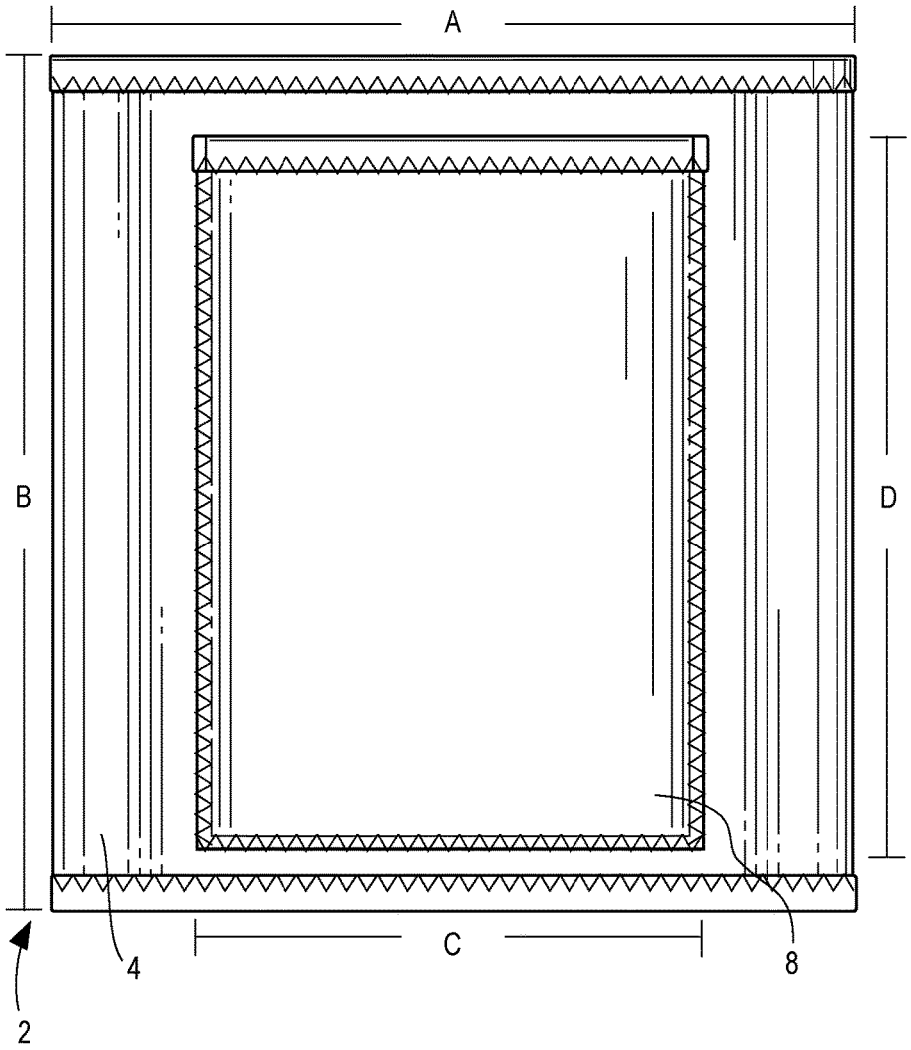
FIGS. 2 and 3 illustrate different side elevational views of the luggage accessory of FIG. 1.

FIG. 2 illustrates a side elevational view of a broad side of luggage accessory 2 including pocket 8 shown FIG. 1. In some aspects, a luggage accessory, with a major surface lying flat on a surface in a relaxed state, can have width A ranging from about 5 inches to about 9 inches, about 5.5 inches to about 8.5 inches, about 6 inches to about 8 inches, about 6.5 inches to about 7.5 inches, about 6.75 inches to about 7.25, or about 7 inches; a height B hanging from about 5 inches to about 9 inches, about 5.5 inches to about 8.5 inches, about 6 inches to about 8 inches, about 6.5 inches to about 7.5 inches, about 6.75 inches to about 7.25, or about 7 inches; a pocket width C ranging from about 2.5 inches to about 5.5 inches, about 3 inches to about 5 inches, about 3.5 inches to about 4.5 inches, about 3.75 inches to about 4.25, or about 4 inches; and a pocket height D ranging from about 4 inches to about 5 inches, about 5.5 inches to about 6.5 inches, about 5.75 inches to about 6.25, or about 6 inches.

Any one or more parts of a luggage accessory, e.g. sleeve, pocket, etc., can generally include writing, indicia, logos, etc. In an embodiment, a logo is provided on a pocket of a luggage accessory.

Figure 3:
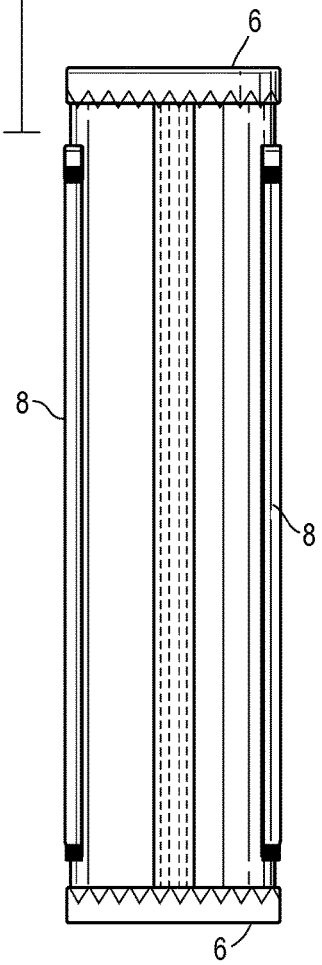
Figure 4:
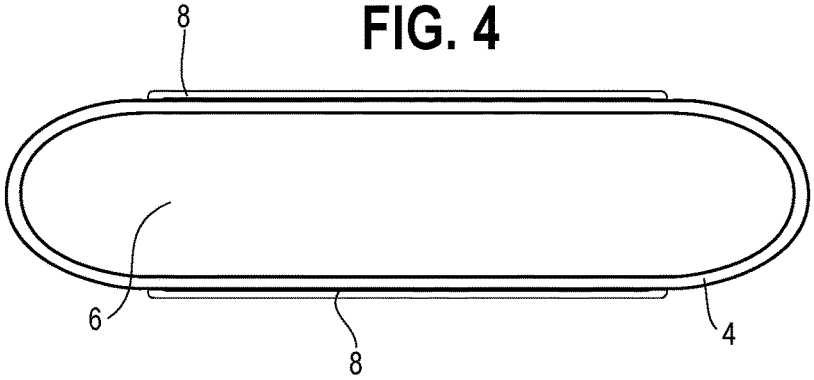
FIG. 4 illustrates a plan view of the luggage accessory of FIG. 1.

FIG. 3 shows a narrow side elevational view of the luggage accessory of FIG. 1. Further illustrated in FIG. 3 are separate pockets 8 formed on opposite sides of the sleeve. FIG. 4 illustrates a plan view of the luggage accessory of FIG. 1. FIG. 4 illustrates a passageway through the sleeve 4, the passageway being accessible through openings 6 on opposite ends of the sleeve 4. FIG. 4 further illustrates pockets 8 disposed on opposite sides of the sleeve 4.

Figure 5:
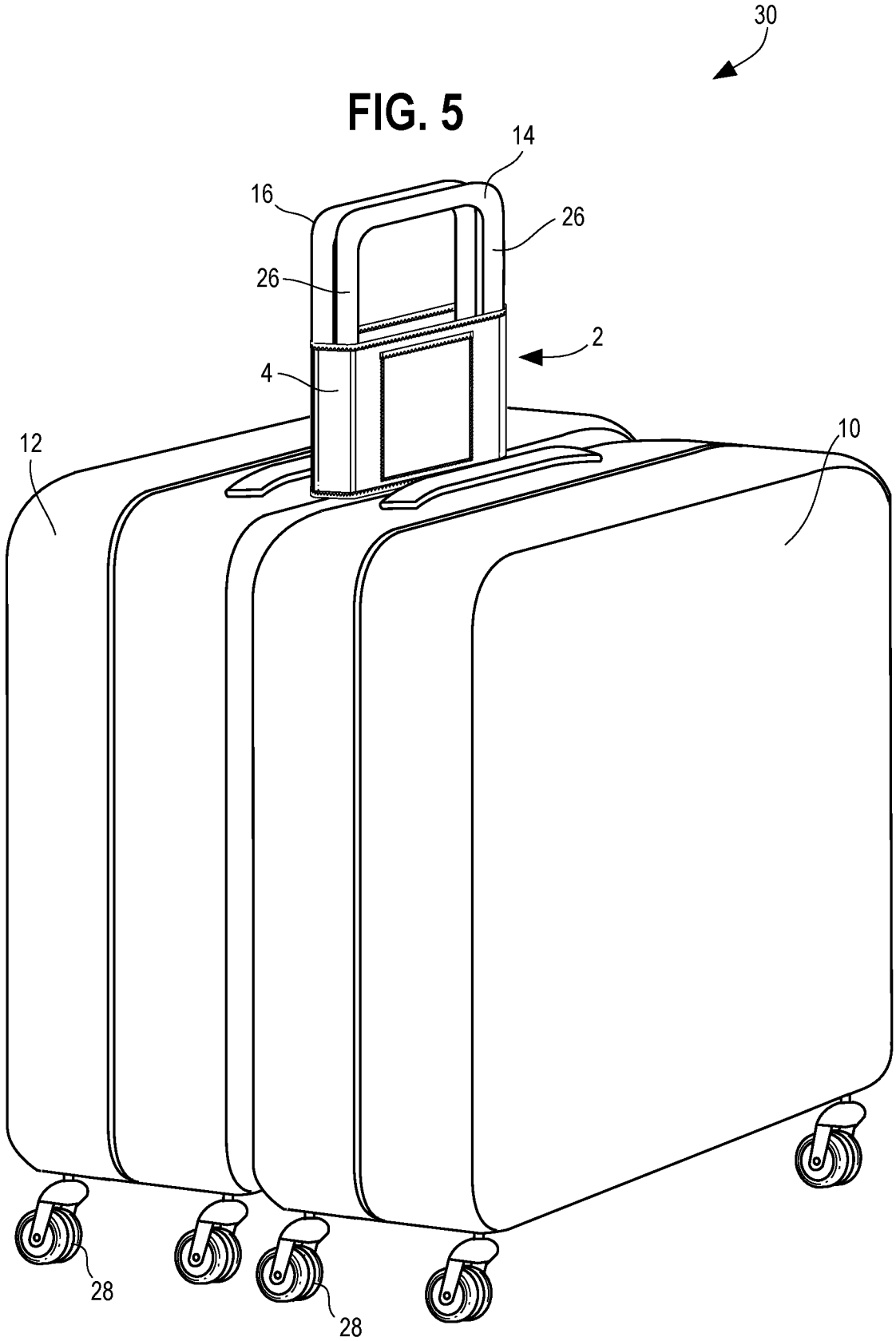
FIG. 5 illustrates a perspective view of an embodiment of a luggage assembly comprising two pieces of luggage and the luggage accessory of FIG. 1.

FIG. 5 illustrates an embodiment of a luggage assembly 30 comprising a first piece of upright rollable luggage 10, a second piece of upright rollable luggage 12, and luggage accessory 2. Both pieces of luggage include caster-type wheels 28. The first piece of luggage further includes an extended luggage handle 14, and the second piece of luggage further includes an extended luggage handle 16. Both handles include spaced apart stanchions 26. The backsides of the pieces of luggage face each other and the extended luggage handles are aligned and positioned together. The handles 14, 16 of the separate pieces of luggage 10, 12 are disposed through the two openings of the sleeve 4. The sleeve conforms to the stanchions 26 of both handles 14, 16 and retains together the handles.

Figure 6:
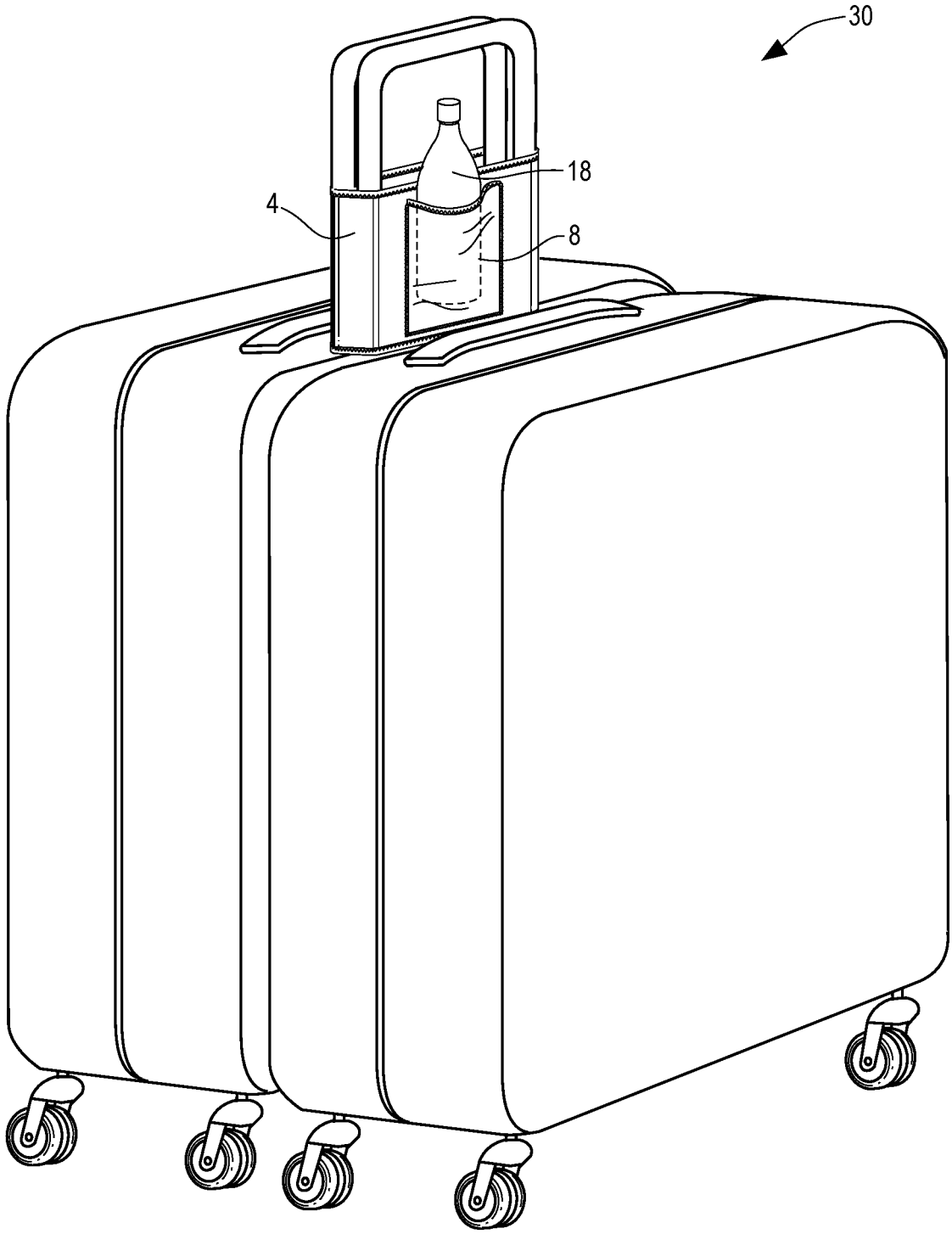
FIG. 6 illustrates the luggage assembly of FIG. 5 with a beverage container placed in a pocket of the luggage accessory.
Figure 7:
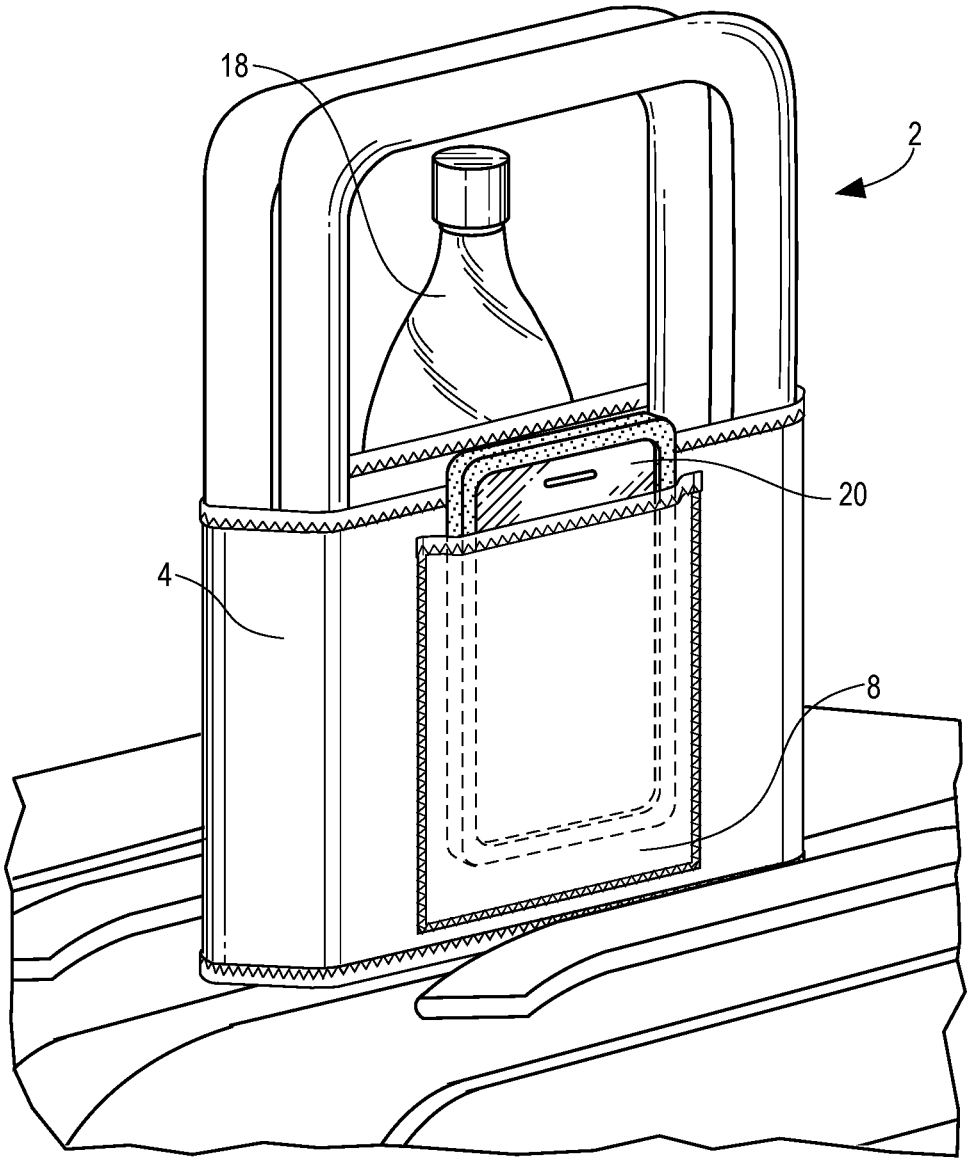
FIG. 7 illustrates an enlarged view of the luggage assembly of FIG. 5 with a beverage container and a mobile electronic device placed in separate pockets of the luggage accessory.

FIG. 6 illustrates the embodiment of the luggage assembly 2 shown in FIG. 5 with a beverage container 18 placed in a pocket 8 disposed on a sleeve 4 of the luggage assembly. FIG. 7 illustrates an enlarged view of the luggage accessory 2 shown in FIG. 5 with a mobile electronic device 20 (e.g., cell phone) placed in a pocket 8 disposed on the sleeve 4 and a beverage container 18 disposed in another pocket (no shown) disposed on an opposite side of the sleeve.

Figure 8:
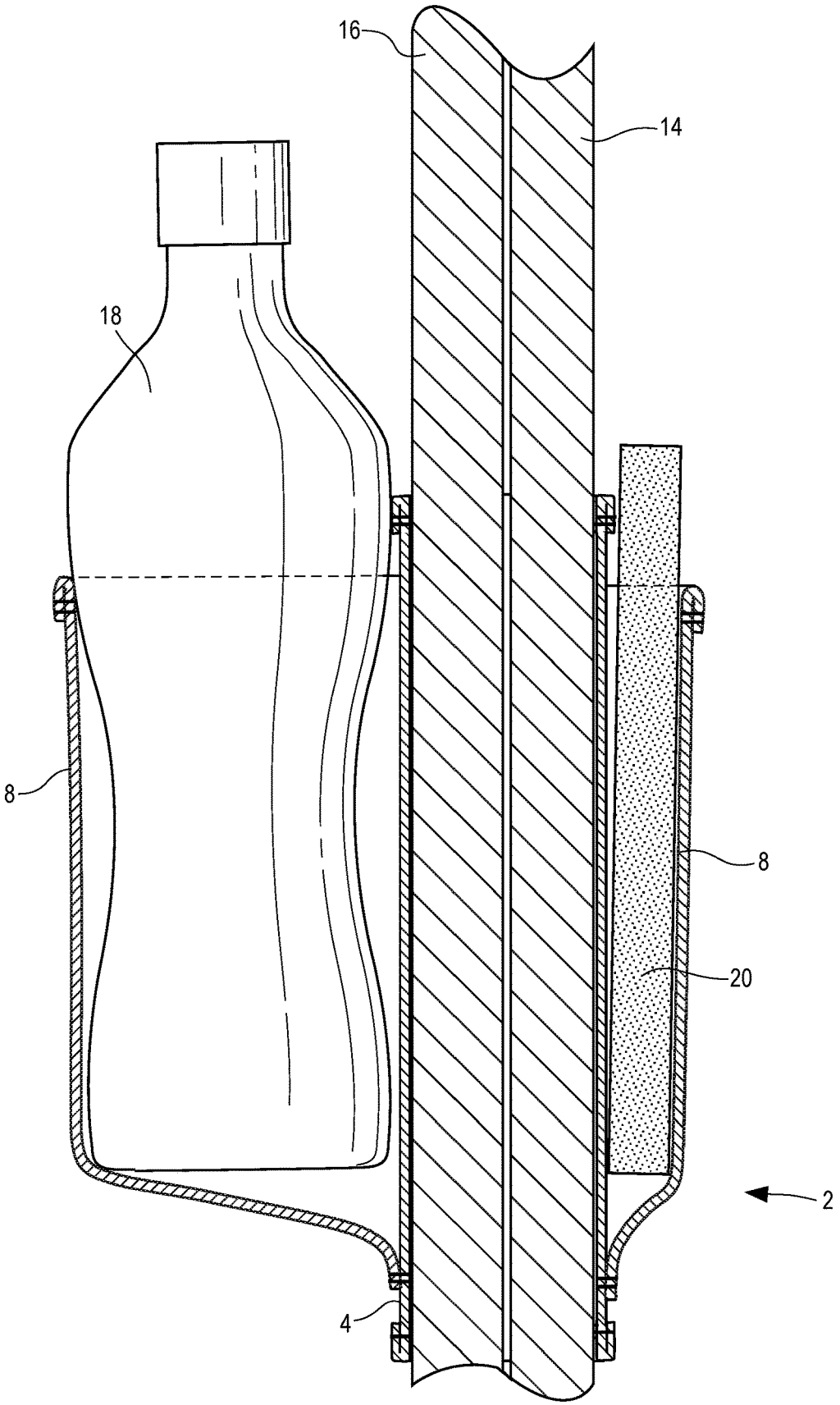
FIG. 8 illustrates a cross-sectional view of a luggage accessory of FIG. 1 with two handles of separate pieces of luggage disposed through the luggage accessory, and a beverage container and a mobile electronic device placed in separate pockets of the luggage accessory.

FIG. 8 illustrates a cross-sectional view of a luggage accessory 2 shown in FIG. 5 with the extended handle 14 of the first piece of luggage and the extended handle 16 of the second piece of luggage disposed through a sleeve 4. A beverage container 18 and mobile electronic device 20 (e.g., cell phone) are placed in separate pockets 8 of the luggage accessory 2.

Figure 9:
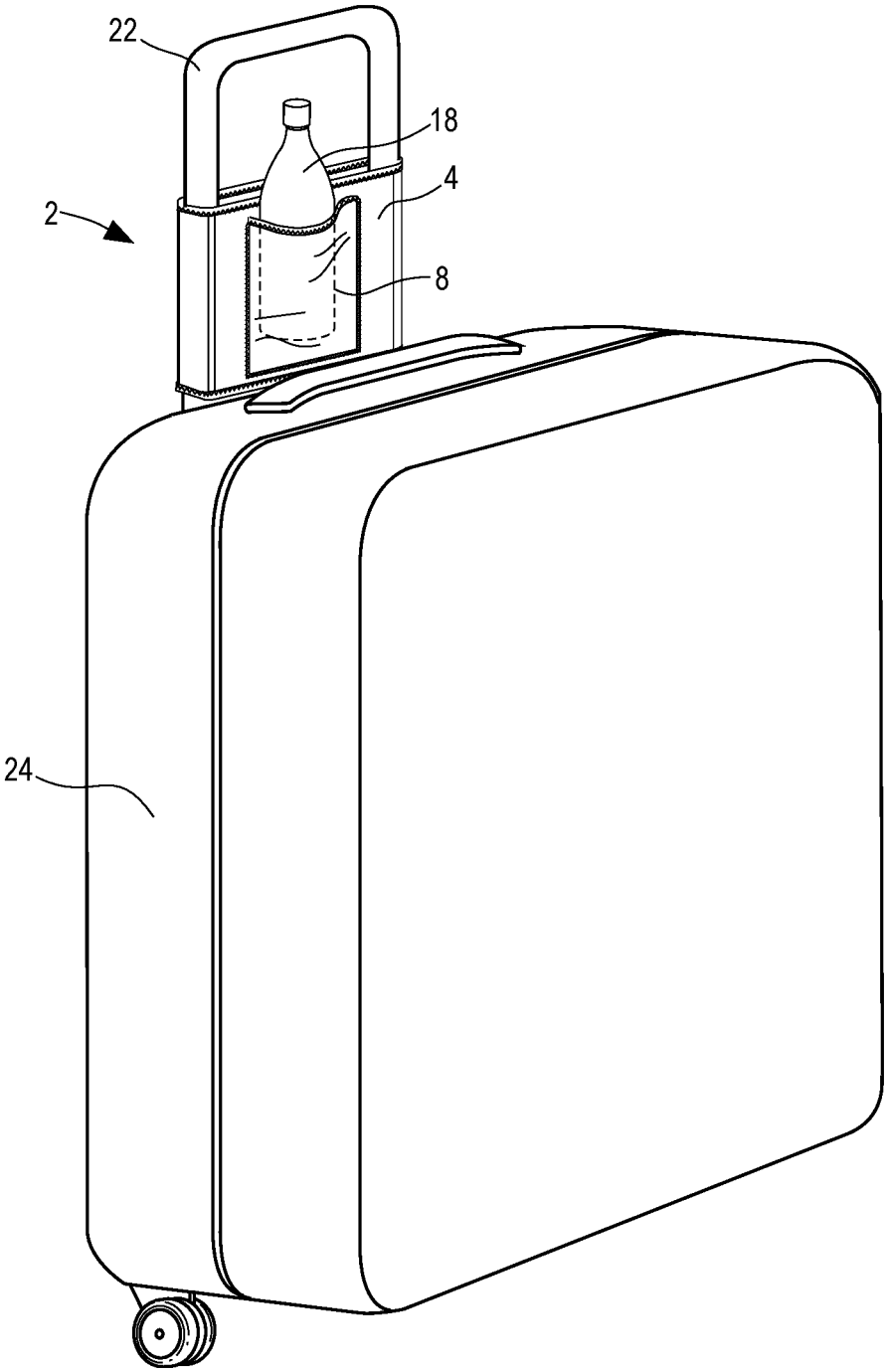
FIG. 9 illustrates a perspective view of embodiment luggage accessory of FIG. 1 disposed on a handle of a single piece of luggage.

FIG. 9 illustrates an embodiment of a luggage accessory 2 disposed on an extended handle 22 of a single piece of luggage 24. A beverage container 18 is placed in a pocket 8 disposed on a sleeve 4 of the luggage accessory. In this embodiment, the single piece of luggage 24 can be tilted for rolling. In this embodiment, a luggage accessory can aid a user by providing one or more pockets useful for holding objects such as beverage bottles, mobile electronic devices, etc.

In some aspects, a luggage accessory can be disposed on an extended handle of a single piece of upright rollable luggage, and the single piece of luggage with the luggage accessory can be rolled while the luggage is standing in the upright position. Like the embodiment shown in FIG. 9, the luggage accessory can aid a user by providing one or more pockets useful for holding objects such as beverage bottles, mobile electronic devices, etc.

All methods described herein can be performed in any suitable order unless otherwise indicated herein or otherwise clearly contradicted by context. The use of any and all examples, or language describing an example (e.g., "such as") provided herein, is intended to illuminate the invention and does not pose a limitation on the scope of the invention. Any statement herein as to the nature or benefits of the invention or of the preferred embodiments is not intended to be limiting. This invention includes all modifications and equivalents of the subject matter recited herein as permitted by applicable law. Moreover, any combination of the above-described elements in all possible variations thereof is encompassed by the invention unless otherwise indicated herein or otherwise clearly contradicted by context. The description herein of any reference or patent, even if identified as "prior," is not intended to constitute a concession that such reference or patent is available as prior art against the present invention. No unclaimed language should be deemed to limit the invention in scope. Any statements or suggestions herein that certain features constitute a component of the claimed invention are not intended to be limiting unless reflected in the appended claims. Neither the marking of the patent number on any product nor the identification of the patent number in connection with any service should be deemed a representation that all embodiments described herein are incorporated into such product or service.

What is claimed is:

1. A luggage assembly comprising:

a first piece of upright rollable luggage including more than two wheels and an extended handle including spaced apart stanchions;

a second piece of upright rollable luggage including more than two wheels and an extended handle including spaced apart stanchions, the handle of the first piece of upright rollable luggage being aligned with and adjacent to the handle of the second piece of upright rollable luggage; and a sleeve including two openings, the spaced apart stanchions of the handles of the first and second pieces of upright rollable luggage being disposed through the two openings of the sleeve, the sleeve conforming to and retaining together the handles of the first and second pieces of upright rollable luggage.

2. The luggage assembly of claim 1, the sleeve simultaneously retaining together and conforming to the spaced apart stanchions of the handles of the first and second pieces of upright rollable luggage in a configuration comprising a backside of the first piece of upright rollable luggage facing a backside of the second piece of upright rollable luggage.

3. The luggage assembly of claim 1, the luggage assembly being rollable in an upright position by one hand of a user with more than two wheels of the first piece of upright rollable luggage more than two wheels of the first piece of upright rollable luggage contacting a surface on which the luggage assembly is rollable.

4. The luggage assembly of claim 1, the sleeve comprising elastic material.

5. The luggage assembly of claim 1, the sleeve comprising neoprene rubber.

6. The luggage assembly of claim 1, the sleeve comprising a tube structure, the sleeve not being formed as a wrap including a fastening mechanism permitting opening of the tube structure and closing back to the tube structure.

7. A method of forming a luggage assembly, the method comprising:

positioning an extended handle of a first piece of upright rollable luggage adjacent to and in alignment with an extended handle of a second piece of upright rollable luggage, the handle of the first piece of upright rollable luggage including spaced apart stanchions, the handle of the second piece of upright rollable luggage including spaced apart stanchions, the first piece of upright rollable luggage including more than two wheels, and the second piece of upright rollable luggage including more than two wheels; and inserting the spaced apart stanchions of the extended handle of the first piece of upright rollable luggage and the spaced apart stanchions of the second piece of upright rollable luggage through a sleeve including two openings, the sleeve simultaneously conforming to and retaining together the extended handles of the first and second pieces of upright rollable luggage.

8. The method of claim 7, the sleeve comprising elastic material.

9. The method of claim 7, the sleeve comprising a tube structure, the sleeve not being formed as a wrap including a fastening mechanism permitting opening of the tube structure and closing back to the tube structure.

* * * * *